US007246738B2

(12) United States Patent
Jonas

(10) Patent No.: US 7,246,738 B2
(45) Date of Patent: Jul. 24, 2007

(54) PACKAGE RECEPTACLE SYSTEM

(76) Inventor: Wiliam Phillip Jonas, 325 W. Joliet Rd., Valparaiso, IN (US) 46385

( * ) Notice: Subject to any disclaimer, the term of this patent is extended or adjusted under 35 U.S.C. 154(b) by 0 days.

(21) Appl. No.: 11/469,520

(22) Filed: Sep. 1, 2006

(65) Prior Publication Data

US 2007/0045391 A1 Mar. 1, 2007

Related U.S. Application Data

(60) Provisional application No. 60/713,558, filed on Sep. 1, 2005.

(51) Int. Cl.
*B65G 11/04* (2006.01)

(52) U.S. Cl. ..... 232/45; 232/34; 232/38; 232/39; 232/29; 232/33; 40/606.06

(58) Field of Classification Search ..... 232/45, 232/34, 38, 39, 19, 17, 29, 33; D99/29–32; 40/606.06, 566
See application file for complete search history.

(56) References Cited

U.S. PATENT DOCUMENTS

| | | | | |
|---|---|---|---|---|
| 1,124,817 | A | 1/1915 | Scott | |
| 1,137,740 | A | 5/1915 | Challeen | |
| 2,194,900 | A | 3/1940 | Helten | |
| 2,444,679 | A * | 7/1948 | Shaukis | 232/35 |
| 2,578,691 | A * | 12/1951 | Gieseler | 232/38 |
| 2,578,693 | A * | 12/1951 | Gieseler | 232/19 |
| 2,932,034 | A * | 4/1960 | Carroll | 2/88 |
| 3,519,198 | A | 7/1970 | Benoliel | |
| 3,880,344 | A | 4/1975 | Earle | |
| 4,863,096 | A * | 9/1989 | Thomas | 232/17 |
| 5,000,378 | A | 3/1991 | Dorr et al. | |
| 5,573,178 | A | 11/1996 | Worden | |
| 5,833,132 | A | 11/1998 | Bachmeier | |
| 6,299,061 | B1 | 10/2001 | Henson | |
| 6,375,070 | B1 * | 4/2002 | Snoke | 232/20 |
| 6,533,167 | B2 | 3/2003 | Hassan | |
| 6,644,542 | B2 | 11/2003 | Cox et al. | |
| 6,719,195 | B2 * | 4/2004 | Farentinos | 232/45 |
| 7,175,071 | B1 * | 2/2007 | Slagle et al. | 232/45 |
| 2002/0162883 | A1 | 11/2002 | Arvonio et al. | |
| 2004/0074957 | A1 * | 4/2004 | Devar | 232/17 |
| 2006/0022028 | A1 * | 2/2006 | Thomas | 232/29 |
| 2006/0169762 | A1 * | 8/2006 | Irwin et al. | 232/45 |

* cited by examiner

*Primary Examiner*—William L. Miller
(74) *Attorney, Agent, or Firm*—Gary M. Hartman; Domenica N. S. Hartman; Hartman & Hartman

(57) ABSTRACT

A package receptacle system including a container having an interior storage compartment, a lower floor within the container for supporting a package placed in the compartment, and sidewalls extending upward from the floor to define an access to the compartment. An upper lid is pivotally attached to the container for closing the access when in a closed position. A feature hangs from the lid for inhibiting rain from entering the compartment when the lid is in a non-closed position. Raised features are present on the floor of the container for supporting a package placed within the compartment above any moisture that might be present on the floor. A feature is included for indicating a recipient's address, and/or a package within the compartment ready for pickup, and/or receipt of a package within the compartment from a delivery service.

20 Claims, 3 Drawing Sheets

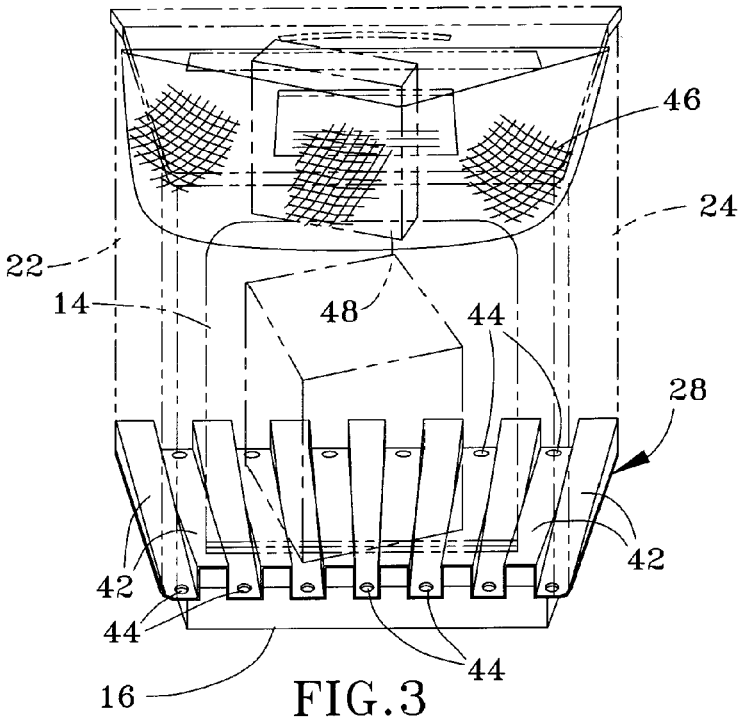
FIG.3
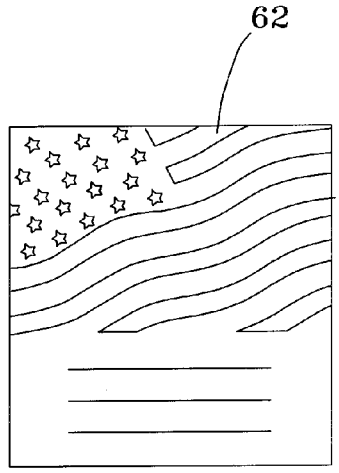
FIG.4
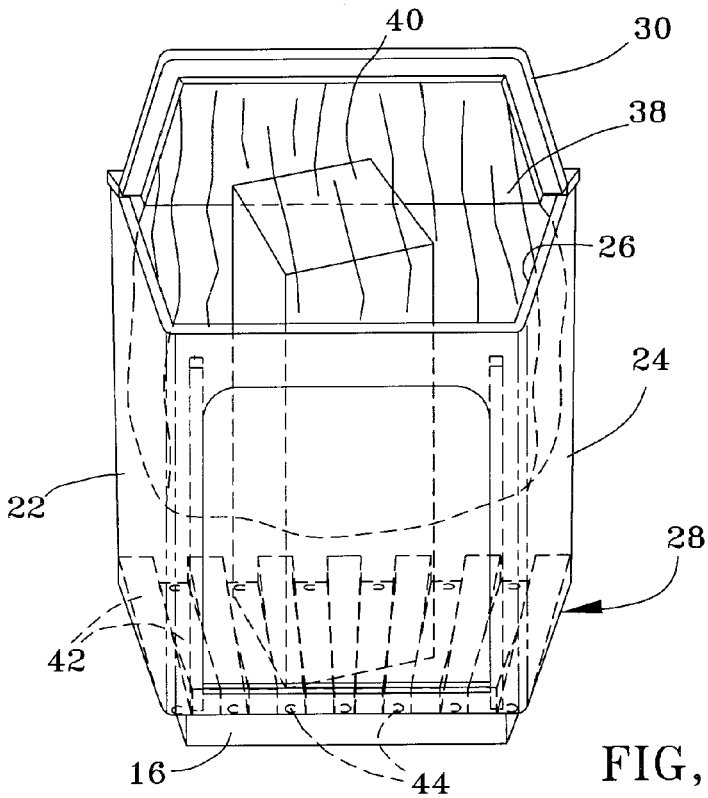
FIG,5

PACKAGE RECEPTACLE SYSTEM

CROSS REFERENCE TO RELATED APPLICATIONS

This application claims the benefit of U.S. Provisional Application No. 60/713,558, filed Sept. 1, 2005, the contents of which are incorporated herein by reference.

BACKGROUND OF THE INVENTION

The present invention generally relates to equipment, systems, and methods for package delivery, and more particularly to equipment, systems, and methods that make use of a protective compartment for receiving parcel packages.

Various receptacles and containment systems have been proposed that are intended for use alone or in conjunction with conventional mailboxes, such as those regulated by U.S. federal government. For example, U.S. Pat. No. 2,194,900 to Helten and U.S. Patent Application Publication No. 2002/0162883 to Arvonio et al. disclose containers sized to receive packages that are too large for standard mailboxes. Helten discloses a parcel delivery box that can be attached to a mailbox post as a separate unit. Arvonio et al. disclose a standalone package delivery receptacle equipped with a signaling device by which a delivery service can be notified of a pickup and the recipient can be notified of a delivery. Still other receptacles are primarily concerned with security, as in the case of a mailbox disclosed in U.S. Pat. No. 5,833,132 to Bachmeier as having a trap door through which mail drops down into a lower container.

Certain conditions have evolved in the mail and package deliver industries that have given rise to a need for further improvements in package delivery systems. Commercial delivery services are used with greater frequency as the cost of fuel rises and the convenience of catalog and Internet shopping becomes more appealing. With increasing package traffic, delivery drivers encounter more difficulties when traveling their routes, including increasing number of stops, the difficulty of ascertaining addresses, the need to place packages where minimal exposure to the weather will occur, long driveways, and unfriendly dogs. Though some packages are sufficiently small to be placed in a mailbox, regulations prohibit placing anything other than stamped mail in a mailbox.

BRIEF SUMMARY OF THE INVENTION

The present invention provides a package receptacle system that can be used in conjunction with an existing mailbox post and readily sized to receive parcel packages of various sizes, including those too large to fit in a standard mailbox.

The package receptacle system includes a container having an interior storage compartment, a lower floor within the container for supporting a package placed in the interior storage compartment, and sidewalls extending upward from the lower floor to define an access to the interior storage compartment. An upper lid is pivotally attached to the container for closing the access. The upper lid is equipped with a feature that hangs from the lid to inhibit rain from entering the interior storage compartment when the lid is raised. The floor of the container is equipped with features that support packages placed within the interior storage compartment above any moisture that might be present on the floor. Finally, the package receptacle system includes a component that indicates a recipient's address, and/or the presence of a package within the interior storage compartment for pickup by a delivery service, and/or the presence of a package within the interior storage compartment received from a delivery service.

A significant advantage of this invention is that the package receptacle system is convenient for both delivery drivers and homeowners. The receptacle system can be used in combination with, and preferably retrofitted to, an existing mailbox post to serve as a secured container for packages that cannot be placed in a mailbox due to size or mail restrictions. Due to its various features, the receptacle system is well-suited for use in residential suburban and rural settings, though uses elsewhere are also envisioned. The receptacle system is preferably configured to have an uncomplicated construction that permits installation by a homeowner.

Other objects and advantages of this invention will be better appreciated from the following detailed description.

BRIEF DESCRIPTION OF THE DRAWINGS

FIG. 3 is a frontal view of the receptacle system of FIG. 1 showing a preferred configuration for the interior of the receptacle system.

FIG. 4 represents a panel that can be installed in a recessed region of the receptacle system of FIG. 1.

FIG. 5 is a frontal view of the receptacle system of FIG. 1 showing the lid raised to reveal a curtain for protecting oversized packages in the receptacle system.

DETAILED DESCRIPTION OF THE INVENTION

Figure 1:
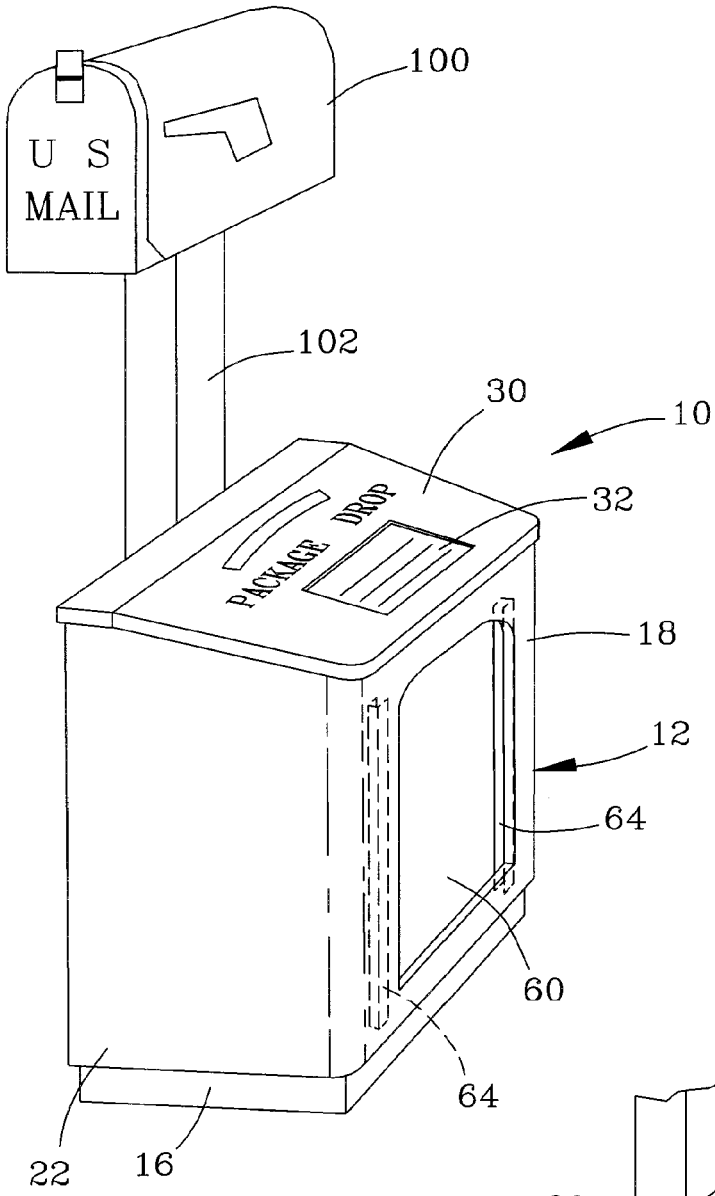
FIG. 1 is a perspective view of a package receptacle system in accordance with a preferred embodiment of this invention.

FIGS. 1 through 7 illustrate a package receptacle system 10 in accordance with a preferred embodiment of the present invention. As depicted in FIG. 1, the receptacle system 10 includes a container 12 adapted for use alongside a conventional mailbox 100. As will be discussed below, the container 12 is preferably configured to be directly secured to the post 102 of the mailbox 100, though such an arrangement is not necessary to use the invention. The container 12 defines an interior storage compartment 14 (FIGS. 3 and 4). The compartment 14 is preferably sized to receive packages too large to fit within a standard mailbox (e.g., the oversized package 40 shown in FIG. 5), though such a capability is not a requirement of the invention. The container 12 has a base 16, sidewalls 18, 20, 22, and 24 that extend upward from the base 16, and an access 26 to the compartment 14 defined by the upper ends of the sidewalls 18, 20, 22, and 24. The base 16 positions the sidewalls 18, 20, 22, and 24 above the surface on which the container 12 is placed. The construction of the container 12 can be a unitary plastic body, such as produced by injection molding, though other unitary constructions are also possible as well as fabrication and assembly of individual parts to form the container 12.

Figure 2:
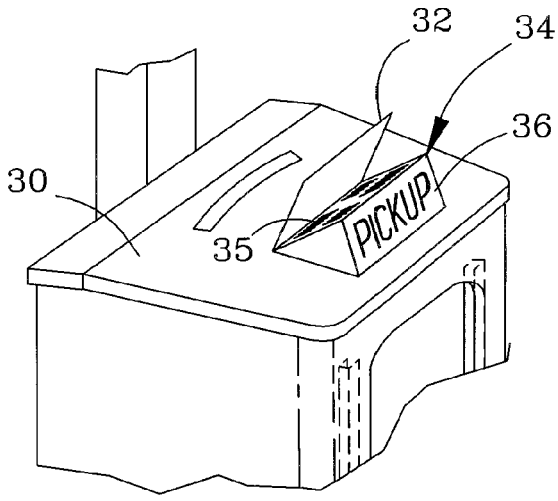
FIG. 2 is a perspective view of a lid of the receptacle system of FIG. 1.

The access 26 to the compartment 14 is shown as being closable with an upper lid 30 that is preferably pivotally attached to the rear sidewall 20 of the container 12. As evident from FIG. 1, the lid 30 is not horizontal when in the closed position so that rain, snow, ice, etc., can be shed by the lid 30. As seen in FIGS. 1 and 2, the lid 30 is equipped with an address placard 32 on which the address of the user can be indicated, such as by writing on or applying a label to the placard 32. As shown in FIG. 2, the placard 32 is preferably located on one surface of the member 34 that is pivotally attached to the lid 30 so that a side surface 36 of the member 34 can be raised for viewing above the upper surface of the lid 30. The side surface 36 of the member 34 can carry a message, such as "pickup" to notify a delivery driver that a package is within the compartment 14 for pickup (FIG. 2). Other messages are also possible, such as "delivery" to indicate that a package has been received from a delivery service.

The placard 32 can also be pivotally secured to the member 34 so that other information, such as a bar code 35 or other scannable graphic code, can be carried on the member 34 beneath the address placard 32 for address confirmation with a visual scanner. This aspect of the invention is particular advantageous if hand-held laser scanners currently used by delivery drivers are adapted for use not only on packages, but also on bar codes permanently affixed at residences to confirm proper delivery. Presently, individual companies are believed to use a different barcoding system, necessitating a different code for each delivery service. However, a universal address code is envisioned that would require only one graphic scan code, which would enable the use of a permanently-etched code in the location of the bar code 35 to indicate the user's address. Alternatively or in addition to a code that can be read with a visual scanner, the system 10 could employ a computer chip, transmitter, or other "proximity-scan" device to provide address data, including devices similar to "speed passes" used at gasoline service stations and drive-by types used in automated toll booths.

FIG. 1 shows the container 12 as having a recessed region 60 on its front sidwall 18. The recessed region 60 is intended to receive and secure changeable panels, such as but not limited to a panel 62 represented in FIG. 4. The panel 62 can be formed of various materials and designed for various purposes, including custom-designed artwork such as the users address, seasonal decor, sports motifs, garden motifs, etc., as well as additional signage such as a "garage sale" notice. U-shaped channels 64 are shown as being located along each edge of the recessed region 60 for securing the panel 62.

FIGS. 3 and 5 show the base 16 of the compartment 14 as defining a floor 28 equipped with raised features capable of supporting packages placed in the compartment 14 above standing water, snow, ice, etc., that may be present on the floor 28. While a variety of features could serve this purpose, FIGS. 3 and 5 represent the raised features as being preferably in the form of two alternating sets of slats or ramps 42, with each set of ramps 42 inclined toward the other. With this configuration, the ramps 42 support packages off the floor 28 while their sloping surfaces channel water out of the floor area through drain holes 44 at the lower end of each ramp 42. By forming the floor 14 to incorporate the ramps 42 and drain holes 44 into the base 16 as one piece, additional bars or grating are not required to be added separately for this purpose.

FIG. 3 also shows the back sidewall 20 of the container 12 as being equipped with a net 46 in which smaller packages 48 can be placed, for example, to provide easy access to the packages 48 and to prevent the packages 48 from being crushed by a larger package (e.g., the oversized package 40 in FIG. 5). The net 46 is preferably elastic to accommodate packages 48 of various sizes.

FIG. 5 shows the lid 30 being equipped with a flexible curtain 38 that hangs from the lower perimeter of the lid 30 to inhibit rain, snow, etc., from entering the compartment 14 when the lid 30 is raised, for example, when the oversized package 40 is placed in the compartment 14. The curtain 38 can be fabricated from essentially any type of material capable of acting as a physical barrier to incursions by rain and snow, and can be a continuous sheet as shown, made up of a number of overlapping individual strips, or some other arrangement that would have the capability of serving as a physical barrier. The curtain 38 is preferably stowable in a pouch (not shown) on the lower surface of the lid 30.

Figure 6:
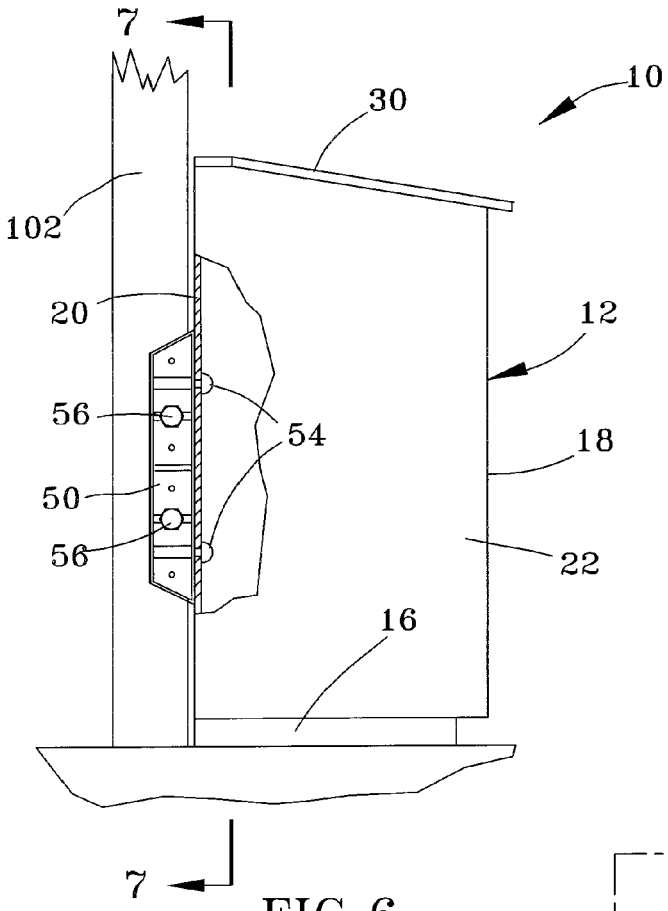
FIGS. 6 and 7 are side and sectional views, respectively, of an adjustable mounting bracket system for securing the receptacle to an existing mailbox post in accordance with a preferred aspect of the invention.
Figure 7:
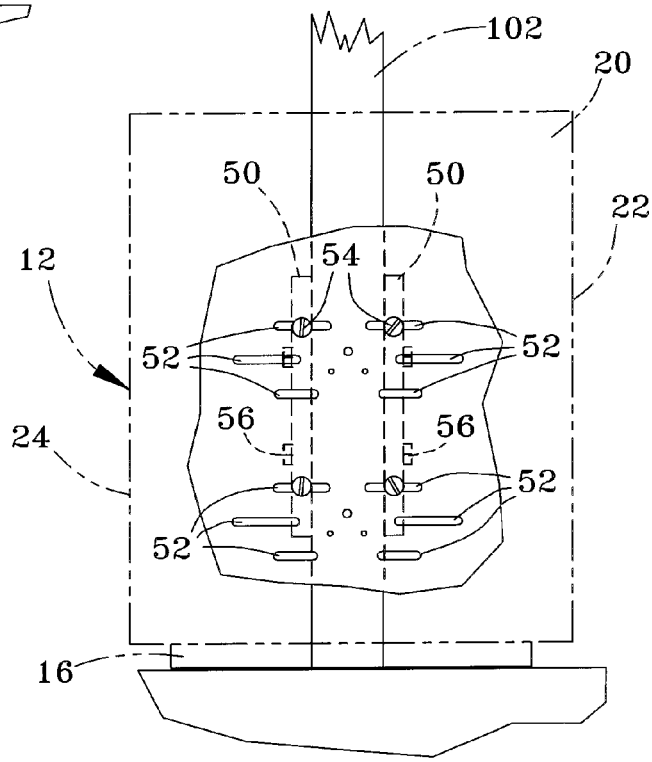

FIGS. 6 and 7 shows a pair of brackets 50 adapted for attaching the container 12 to the mailbox post 102. The brackets 50 are configured to be adjustably secured to the back sidewall 20 of the container 12 in order to accommodate posts 102 of various cross-sections, e.g., from two to ten inches. For this purpose, the back sidewall 20 of the container 12 is preferably formed to have two sets of horizontal slots 52 through which bolts 54 or any other suitable fasteners can be inserted to secure the brackets 50 to the container 12 and allow for horizontal adjustment of the brackets 50 to accommodate the width of the post 102. A second set of bolts 56 can then be inserted through holes in the brackets 50 that are transverse to the bolts 54 for securing the brackets 50 to opposite sides of the post 102.

From the above, it can be appreciated that the package receptacle system 10 of this invention is able to be quickly and simply secured to nearly any existing post. As such, the system 10 is adapted to be retrofitted to an existing mailbox post 102 to serve as a nonsecure container for package delivery. The system 10 is particularly well-suited for residential usage in suburban, rural, and other settings where parcel deliveries are made and a conventional roadside mailbox installation is present. The system 10 safely accommodates and protects both oversized packages (40) and small packages (48), as well as provides delivery space for express delivery companies and others that are barred from using mailboxes designated for stamped mail delivery.

In addition to the features outlined above, the package receptacle system 10 could be equipped with a variety of other accessories. For example, a radio-frequency contact switch (not shown) could be installed on the container 12 to ring a bell inside the user's house when the lid 30 is raised, letting the user know that a pickup or delivery has occurred. The contact switch could be mounted just under the lid 30 and powered with batteries, with a radio-receiver/alarm unit powered by an electrical outlet in the house. Furthermore, the system 10 could be equipped with a locking mechanism on the lid 30 or access-limited compartments intended for holding packages out of the weather until the user can retrieve them.

In view of the above, while the invention has been described in terms of a preferred embodiment, it is apparent that other forms could be adopted by one skilled in the art. Therefore, the scope of the invention is to be limited only by the following claims.

The invention claimed is:

1. A package receptacle system for use with an associated mailbox, the package receptable system comprising:

a container having an interior storage compartment sized to receive a package too large to fit within the associated mailbox, the container having a lower floor adapted for supporting a package placed in the interior storage compartment, sidewalls extending upward from the lower floor, and an access to the interior storage compartment defined by upper ends of the sidewalls;

an upper lid pivotally attached to the container for closing the access when in a closed position;

means hanging from the upper lid for inhibiting rain from entering the interior storage compartment when the upper lid is in a non-closed position;

raised features on the floor of the container for supporting a package placed within the interior storage compartment above moisture if present on the floor; and means for indicating at least one of a recipient's address, a package within the interior storage compartment for pickup by a delivery service, and receipt of a package within the interior storage compartment from a delivery service.

2. The package receptacle system according to claim 1, further comprising means for attaching the container to a mailbox post.

3. The package receptacle system according to claim 1, wherein the raised features comprise an alternating pattern of ramps inclined toward each other.

4. The package receptacle system according to claim 1, wherein the indicating means is mounted on the upper lid of the container.

5. The package receptacle system according to claim 1, wherein the indicating means comprises both means for indicating the recipient's address and means for indicating a package within the interior storage compartment for pickup by a delivery service.

6. The package receptacle system according to claim 1, wherein the indicating means comprises a member on which address identification information can be placed.

7. The package receptacle system according to claim 6, wherein the member is pivotally attached to the upper lid of the container and when in a raised position relative to the upper lid indicates that a package is within the interior storage compartment for pickup by a delivery service.

8. The package receptacle system according to claim 1, wherein the inhibiting means comprises a flexible curtain attached to the upper lid.

9. The package receptacle system according to claim 8, wherein the curtain is attached to the upper lid so as to hang within and be entirely contained by the interior storage compartment when the upper lid is in the closed position.

10. A package receptacle system according to claim 1, further comprising means for draining the interior storage compartment.

11. A package receptacle system according to claim 1, further comprising a pouch attached to at least one of the sidewalls for receiving a package.

12. A package receptacle system according to claim 11, wherein the pouch is sized to suspend a package received therein above the floor of the interior storage compartment.

13. A package receptacle system according to claim 1, further comprising at least one panel and means on an exterior surface of at least one of the sidewalls for removably receiving the panel.

14. A package receptacle system according to claim 13, wherein the receiving means comprises a recessed surface region on the at least one sidewall and means for securing the panel within the recessed surface region.

15. A package receptacle system for use with an associated mailbox, the package receptable system comprising:

a container having an interior storage compartment sized to receive a package too large to fit within the associated mailbox, the container having a lower floor adapted for supporting a package placed in the interior storage compartment, sidewalls extending upward from the lower floor, and an access to the interior storage compartment defined by upper ends of the sidewalls;

means for attaching the container to a mailbox post and configured to accommodate mailbox posts of different cross-sections;

an upper lid pivotally attached to the container for closing the access when in a closed position, the upper lid being non-horizontal when in the closed position;

a flexible curtain hanging from the upper lid for inhibiting rain from entering the interior storage compartment when the upper lid is in a non-closed position;

raised features on the floor of the container for supporting a package placed within the interior storage compartment above moisture if present on the floor;

means for indicating an address; and means for indicating a package within the interior storage compartment for pickup by a delivery service.

16. The package receptacle system according to claim 15, wherein the raised features comprise an alternating pattern of ramps inclined toward each other.

17. The package receptacle system according to claim 15, wherein the address indicating means and the package indicating means are defined by two surfaces of a member pivotally mounted to the upper lid of the container, the member conceals the package indicating means when in a lowered position relative to the upper lid, and the member exposes the package indicating means when in a raised position relative to the upper lid.

18. The package receptacle system according to claim 15, wherein the curtain is attached to the upper lid so as to hang within and be entirely contained by the interior storage compartment when the upper lid is in the closed position.

19. A package receptacle system according to claim 15, further comprising a pouch attached to at least one of the sidewalls for receiving a package, the pouch being sized to suspend a package received therein above the floor of the interior storage compartment.

20. A package receptacle system according to claim 15, further comprising at least one panel, a recessed surface region on an exterior surface of at least one of the sidewalls, and means for securing the panel within the recessed surface region.

* * * * *